US005575269A

United States Patent [19]

Harklau

[11] Patent Number: 5,575,269

[45] Date of Patent: Nov. 19, 1996

[54] BOWSTRING RELEASE MECHANISM

[76] Inventor: Lanny L. Harklau, 2860 Ice Rose La., Stillwater, Minn. 55082

[21] Appl. No.: 524,269

[22] Filed: Sep. 6, 1995

[51] Int. Cl.[6] ..... F41B 5/18

[52] U.S. Cl. ..... 124/35.2; 124/32; 124/33

[58] Field of Search ..... 124/31, 32, 33, 124/35.2

[56] References Cited

U.S. PATENT DOCUMENTS

| | | | |
|---|---|---|---|
| 1,179,301 | 4/1916 | Hammond | 124/33 X |
| 1,909,416 | 5/1933 | Nemmers | 124/33 |
| 2,072,746 | 3/1937 | Foster et al. | 124/33 |
| 3,770,981 | 11/1973 | Nelsen | 124/32 X |
| 4,674,469 | 6/1987 | Peck | 124/35.2 |
| 4,823,761 | 4/1989 | Lewis | 124/35.2 |
| 4,877,009 | 10/1989 | Becker | 124/35.2 |
| 5,025,772 | 6/1991 | Stevenson | 124/35.2 |
| 5,027,786 | 7/1991 | Peck | 124/35.2 |
| 5,205,268 | 4/1993 | Savage | 124/24.1 |
| 5,243,957 | 9/1993 | Neilson | 124/88 |

OTHER PUBLICATIONS

Randy Ulmer with John Sielicki, "Releasing the Shot", *Petersen's Bowhunting*, Jul. 1995, p. 16.

Advertisement for "Cantpunch" bowstring release, Archery Magazine, Nov. 1978, p. 24.

"More on Target Panic", Archery Magazine, Oct. 1979, p. 6.

*Primary Examiner*—John A. Ricci

*Attorney, Agent, or Firm*—Kinney & Lange

[57] ABSTRACT

A bowstring release apparatus for use with a bowstring affixed to a bow is disclosed. The bowstring release apparatus comprises an activation switch connected to a timing device which in turn is connected to a release mechanism. Actuation of the activation switch initiates a time period whose length is established by the timing device. The release mechanism releases the secured bowstring after expiration of the time period. Additionally, a method for improving the shooting accuracy of an archer by providing a bow, a bowstring affixed to the bow, an arrow and a bowstring release apparatus is disclosed. The method includes the archer drawing the bowstring and activating an activation switch. After completion of a time period, the bowstring will automatically be released. The duration of the time period is determined by a timing device which is responsive to the activating of the activation switch.

14 Claims, 8 Drawing Sheets

BOWSTRING RELEASE MECHANISM

BACKGROUND OF THE INVENTION

The present invention concerns an archery device for assisting in producing accurate shots. More particularly, it concerns a bowstring release mechanism with a programmable time delay.

Many archers in both hunting and target shooting experience inaccurate shots due to flinching or movement at the critical time of releasing the bowstring to launch an arrow. Flinching or movement can be caused by anticipation of a shot, physical breakdown, or mental deterioration.

Anticipation of the shot, or target anxiety, often causes tension and excessive movement in the bow due to the expectation of the coming explosion and recoil of the shot. After drawing the bowstring and arrow, the archer takes aim. Physical breakdown of the shot normally occurs when the archer has aimed too long. The maximum ideal holding period is 5–7 seconds. Thus, when an archer is at full draw for too long, his or her muscles begin to weaken and shooting form breaks down causing an inaccurate shot. Finally, mental deterioration occurs due to the mind's inability to concentrate on more than one thing at a time. During execution of a shot, the archer should be focussed exclusively on aiming. Focussing on other events such as gently releasing the bowstring or a trigger, utilizing a proper breathing technique and exercising self control to draw down if all the requisite conditions to a good shot are not met, may inhibit the archer from maintaining a proper site picture and thus result in an inaccurate shot.

Use of conventional mechanical or electrical release mechanisms do not address or alleviate these concerns. The archer must still perform the aforementioned requisite conditions along with aiming during the critical time of shot release thereby increasing the likelihood of flinching or movement during that time.

U.S. Pat. No. 5,243,957 illustrates this limitation. The '957 patent discloses a release mechanism for use with a two handed bow activated by a trigger switch on one of the hand grips. At the critical time of releasing the bowstring, an archer still must be concerned with gently activating the trigger, utilizing a proper breathing technique, exercising self-control to draw down the bow if the requisite conditions are not met and maintaining a proper site picture or focus on the target. Attempting to achieve all these conditions at the critical time increases the likelihood of mental deterioration and physical breakdown. Furthermore, because the archer knows the bowstring will release immediately upon activation of the switch, anticipation of the shot and the associated movement or flinching will only compound the difficulty of achieving an accurate shot.

Therefore, a substantial need exists for a device which alleviates archer movement or flinching at the critical time of bowstring release.

SUMMARY OF THE INVENTION

The invention discloses a bowstring release apparatus for use with a bowstring affixed to a bow. The bowstring release mechanism is comprised of an activation switch, a timing device and a release mechanism. The activation switch is connected to the timing device which in turn is connected to the release mechanism. The bowstring release apparatus is activated by the activation switch which initiates the start of a time period. The timing device, connected to the activation switch, establishes a length of time representing the time period. The release mechanism, connected to the timing device, releases the secured bowstring after expiration of the time period. In a preferred embodiment of the invention, the timing device comprises a constant time device and a random time device which are both programmable.

DETAILED DESCRIPTION OF THE PREFERRED EMBODIMENTS

Figure 1:
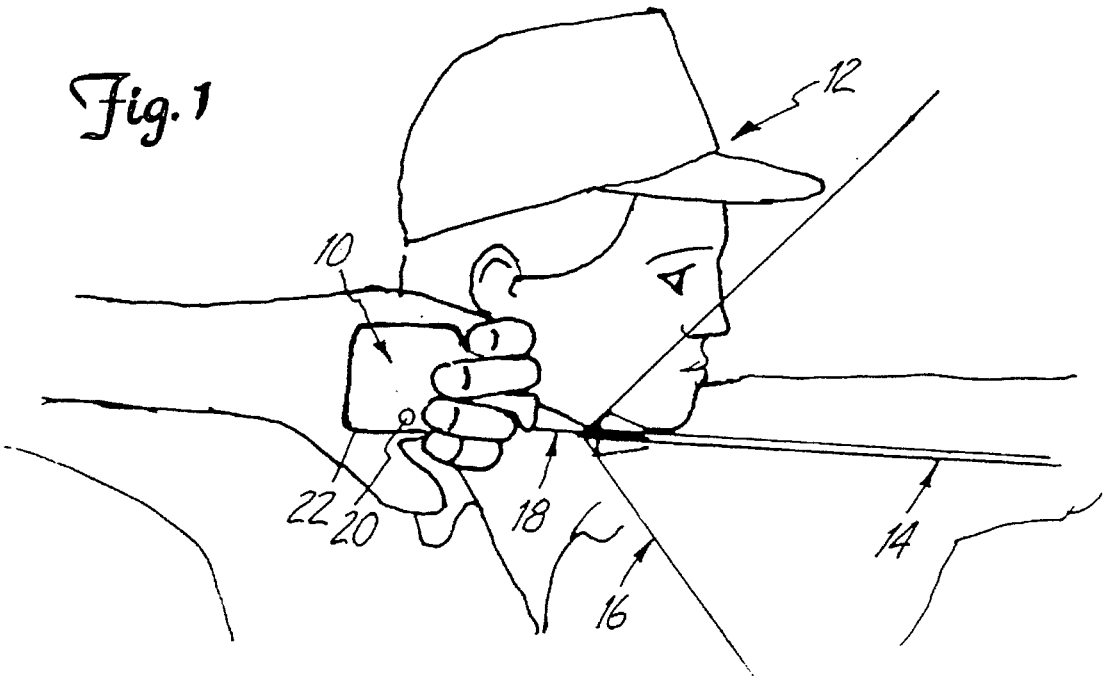
FIG. 1 is a perspective view of a drawn bow incorporating the bowstring release mechanism of the present invention.

In FIG. 1, a preferred embodiment of the bowstring release mechanism 10 is shown being used by an archer 12 to shoot an arrow 14 by releasably securing a bowstring 16. The bowstring release mechanism 10 as depicted includes a retainer loop 18, an activation switch 20 and a case 22. The activation switch 20 is preferably a switch or button positioned on the case 22 for easy actuation by the archer 12. The switch could also be located elsewhere on the case 22 to satisfy personal preference. Various means for securing the bowstring 16 to the bowstring release mechanism 10 are known in the art. In the preferred embodiment the retainer loop 18 performs this function.

The archer 12 utilizes the bowstring release mechanism 10 by securing it to the bowstring 16 with the retainer loop 18. The archer 12 then draws the bowstring 16 and obtains a proper sight picture. Upon achieving a proper sight picture, the archer 12 actuates the activation switch 20 which initiates a firing sequence. As will later be described in greater detail, a random time delay is incorporated into the firing sequence and occurs after actuation of the activation switch 20. In the preferred embodiment, "random" refers to pseudorandom in that the time delay period must occur within an established interval of time as described below. The random time delay allows the archer 12, after actuating the activation switch 20, to reacquire a proper sight picture and focus exclusively on aiming. Upon expiration of the random time delay, the bowstring release mechanism 10 causes the retainer loop 18 to release the bowstring 16 and launch the arrow 14.

The invention improves the shot of the archer 12 by incorporating the random time delay into the firing sequence to prevent archer flinching or movement. Shot anticipation is eliminated due to the shot occurring at an unknown time after actuation of the activation switch 20. Mental deterioration does not occur once the activation switch 20 is actuated, no other actions are required, and thus the archer 12 can focus exclusively on aiming. Finally, physical deterioration is prevented by establishing a range of potential random times to ensure the shot occurs prior to physical breakdown.

Figure 2:
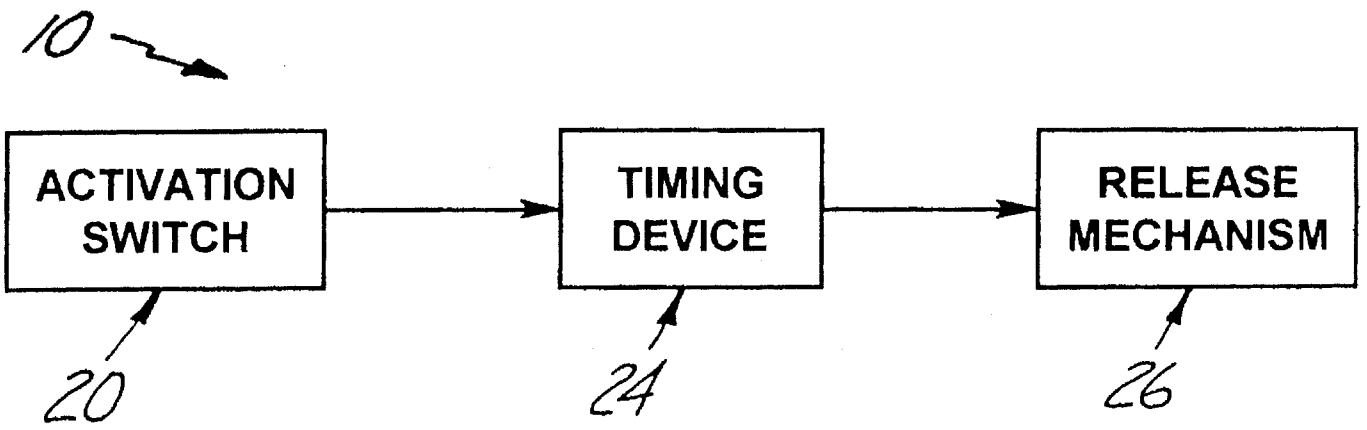
FIG. 2 is a block diagram of the bowstring release mechanism.

FIG. 2 is a block diagram of the bowstring release mechanism 10, providing further detail of its components. As shown in FIG. 2, the bowstring release mechanism 10 includes the activation switch 20, a timing device 24 and a release mechanism 26 which includes the retainer loop 18 (shown in FIG. 1). The activation switch 20 is connected to the timing device 24 which in turn is connected to the release mechanism 26.

Actuation of the activation switch 20 initiates operation of the timing device 24 and begins the firing sequence. This occurs by the activation switch 20 sending an arm signal to the timing device 24. After receipt of the arm signal, the timing device 24 processes the random time delay into the firing sequence. Upon expiration of the random time delay, the timing device 24 sends a fire signal to the release mechanism 26. For the duration of the fire signal sent by the timing device 24 to the release mechanism 26, a power source provides power to the release mechanism 26. Once powered, the release mechanism 26 automatically releases the bowstring 16 and fires the arrow 14 (shown in FIG. 1).

Figure 3:
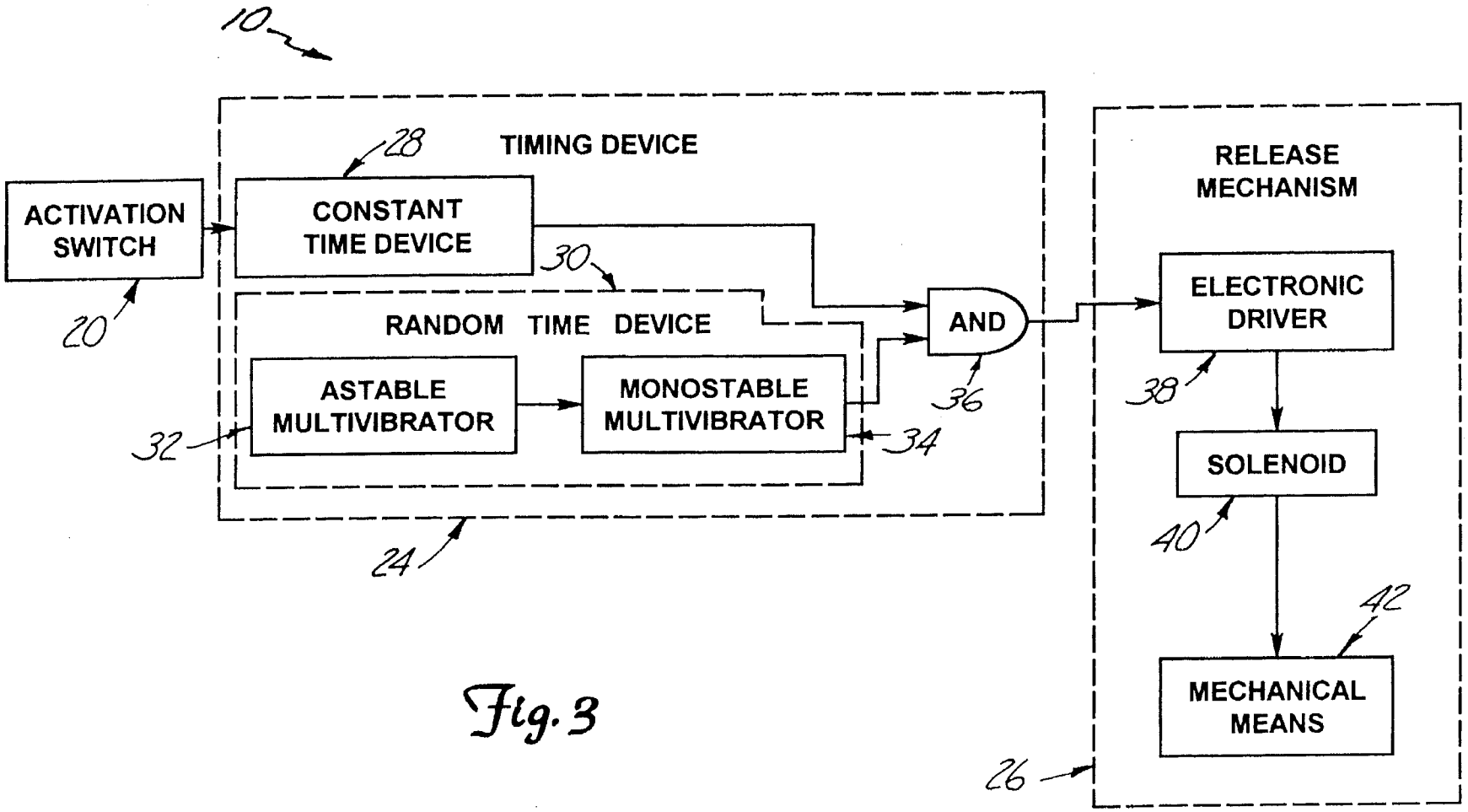
FIG. 3 is a block diagram detailing the subcomponents of the bowstring release mechanism.

FIG. 3 is a block diagram further identifying the components of the preferred bowstring release mechanism 10. As depicted in FIG. 3, the timing device 24 contains a constant time device 28, a random time device 30 comprising an astable multivibrator 32 and a monostable multivibrator 34, and an AND gate 36. The release mechanism 26 contains an electronic driver 38, a solenoid 40 and a mechanical means 42 which in the preferred embodiment includes the retainer loop 18 (shown in FIG. 1). The activation switch 20 is connected to the constant time device 28. The astable multivibrator 32 is connected to the monostable multivibrator 34. Both the constant time device 28 and the random time device 30 (via the monostable multivibrator 34) are connected to the AND gate 36. The AND gate 36 is connected to the electronic driver 38 thus connecting the timing device 24 to the release mechanism 26. The electronic driver 38 is connected to the solenoid 40 which is connected to the mechanical means 42.

The activation switch 20 commences the firing sequence by transmitting the arm signal to the timing device 24. Basically, the timing device 24 will send a fire signal, via the AND gate 36 to the release mechanism 26 after a random time delay. The AND gate 36 will send the fire signal once it has received simultaneous ready signals from both the constant time device 28 and the random time device 30. In other words, the arm signal initiates operation of the constant time device 28 which incorporates an established delay time into the firing sequence. After expiration of the delay time, the constant time device 28 transmits a ready signal to the AND gate 36. The length of the established delay time is known to the archer 12 (shown in FIG. 1) and enables the archer 12 to reacquire a proper sight picture after actuating the activation switch 20. In the preferred embodiment the length of time representing the delay time is adjustable over an established range and can be set by the archer 12.

After receiving the ready signal form the constant time device 28, the AND gate 36 awaits a similar signal from the random time device 30. The random time device 30 operates by having the astable multivibrator 32 run continuously, generating a square wave. The rising edge of the astable multivibrator 32 triggers the monostable multivibrator 34. The monostable multivibrator 34 output signal is then transmitted as the ready signal for the random time device 30 to the AND gate 36. In the preferred embodiment the period of the square wave is adjustable over an established range and can be preset.

Upon receiving ready signals from the constant time device 28 and the random time device 30, the AND gate 36 transmits the fire signal to the electronic driver 38 of the release mechanism 26. By use of the AND gate 36 which requires ready signals from both the constant time device 28 and the random time device 30, an interval of potential points in time that the fire signal could be given is created. This interval begins upon expiration of the delay time created by the constant time device 28 and extends for a period of time generated by the random time device 30. Basically, this period of time is equal to one period of oscillation of the astable multivibrator 32. Within each period of oscillation of the astable multivibrator 32, the monostable multivibrator 34 sends a ready signal to the AND gate 36 for the random time device 30. Thus, once the constant time device 28 sends its ready signal, the random time device 30 will send a ready signal within one period of oscillation of the astable multivibrator 32. Therefore, the amount of time after which the constant time device 28 transmits its ready signal until the random time device 30 transmits its ready signal will be dependant upon where in the astable multivibrator 32 period of oscillation the delay time expires. This period of time, after expiration of the delay time and prior to the random time device 30 ready signal, is known as the random time. Thus, the delay time and random time taken together constitute the entire time delay.

The electronic driver 38, after receiving the fire signal from the AND gate 36, then powers the solenoid 40 for the duration of the fire signal. The solenoid 40 drives the mechanical means 42 such that the bowstring 16 (shown in FIG. 1) is released. In order to conserve the amount of power expended per shot, the length of the fire signal, or amount of time the solenoid 40 is powered, is kept to a minimum. The minimum amount of time required to power the solenoid 40 is that period of time just long enough for the solenoid 40 to drive the mechanical means 42 to cause release of the bowstring 16 (shown in FIG. 1). Any longer period needlessly expends power, shortening the life of the power source. Thus the length of the fire signal is limited to and dependant upon the amount of time it takes the mechanical means 42 to release the bowstring 16 (shown in FIG. 1).

In an alternative embodiment, the constant time device 28 and the astable multivibrator 32 are connected to an AND gate. The AND gate drives the monostable multivibrator 34, which in turn provides the fire signal to the electronic driver 38. With this alternate configuration, the AND gate will drive the monostable multivibrator 34 once it has received ready signals from both the constant time device 28 and the astable multivibrator 32. The monostable multivibrator 34 will provide the fire signal to the electronic driver 38 when its oscillating signal goes high.

Figure 4:
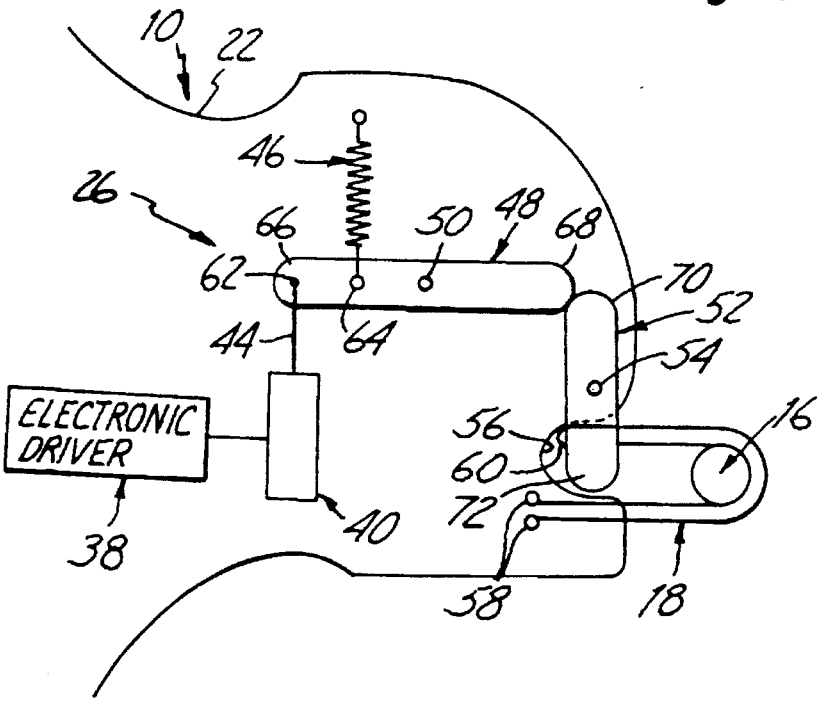
FIG. 4 is an enlarged view of the release mechanism in a secured position.
Figure 5:
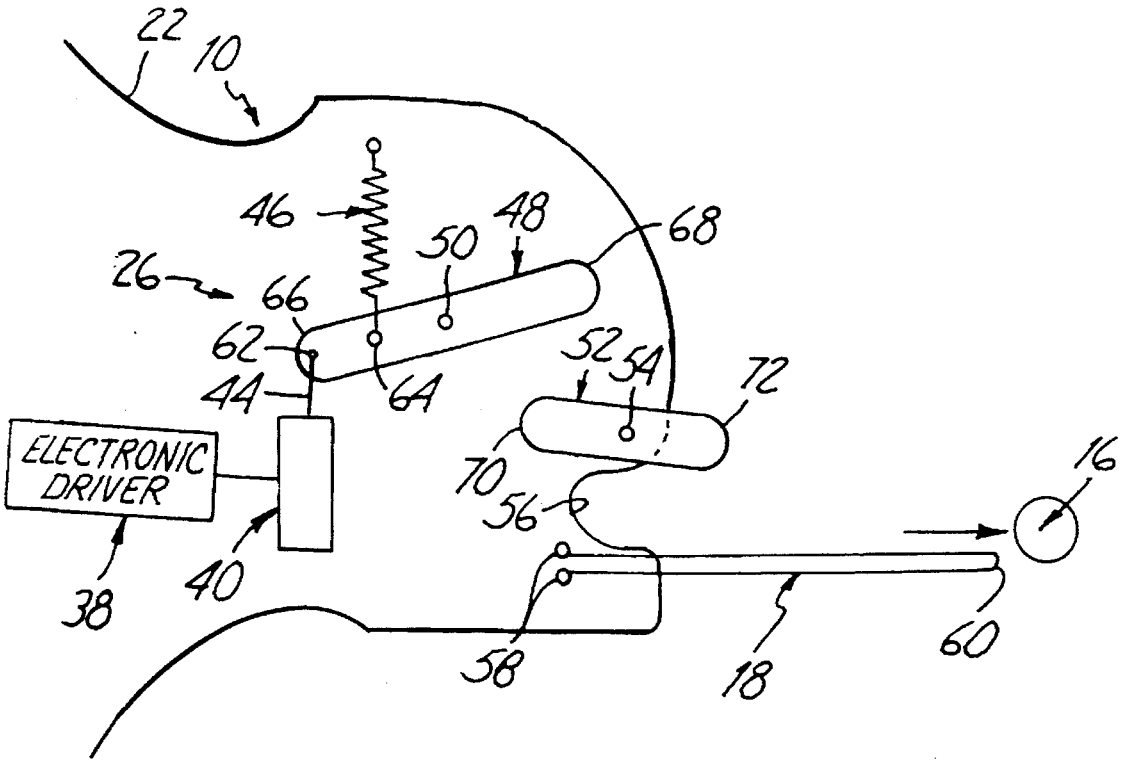
FIG. 5 is an enlarged view of the release mechanism in a released position.

Various mechanical means 42 are known in the art to releasably secure the bowstring 16. FIGS. 4 and 5 provide an enlarged view of the release mechanism 26 used in the preferred embodiment. The release mechanism 26 includes the electronic driver 38, the solenoid 40 with a plunger 44, a spring 46, a horizontal arm 48 with a pivot point 50, a vertical arm 52 with a pivot point 54, a notch 56 and the retainer loop 18 which holds the bowstring 16. The bowstring 16 in FIGS. 4 and 5 is shown in a rotated and cross sectional view from its normal position to enhance the depiction of the retainer loop 18 and its associated features.

The retainer loop 18 is connected to the bowstring release mechanism 10 at a connection point 58 and has a looped end 60. The electronic driver 38 is connected to the solenoid 40. The solenoid 40 is also connected to horizontal arm 48 by way of its plunger 44 at connection point 62. The horizontal arm 48 is connected to the spring 46 at connection point 64. The horizontal arm 48 has ends 66 and 68 while the vertical arm 52 has ends 70 and 72. The end 68 of the horizontal arm 48 makes contact with the end 70 of the vertical arm 52.

In the preferred embodiment, the bowstring 16 is releasably secured to the release mechanism 26 by first wrapping the retainer loop 18 around the bowstring 16 and then placing the looped end 60 of the retainer loop 18 around the vertical arm 52 at the end 72. The vertical arm 52 is then rotated clockwise about the pivot point 54, thus enclosing the notch 56 as depicted in FIG. 4. During rotation, the end 70 of the vertical arm 52 comes into contact with the end 68 of the horizontal arm 48. This contact causes the horizontal arm 48 to rotate slightly counterclockwise, allowing the vertical arm 52 to attain a secured position as shown in FIG. 4. The vertical arm 52 is held in the secured position due to the end 70 contacting the horizontal arm 48 at the end 68. The horizontal arm 48 is normally held in the secured position depicted in FIG. 4 by the spring 46.

In order to release the bowstring 16 as depicted in FIG. 5, the electronic driver 38 (after receiving the fire signal from the timing device 24 shown in FIG. 3) powers the solenoid 40 which actuates the plunger 44 in a downward direction. This causes the horizontal arm 48 to rotate counterclockwise about the pivot point 50 and elongates the spring 46. The vertical arm 52 is allowed to rotate in a counterclockwise direction about the pivot point 54 due to pressure from the looped end 60 of the retainer loop 18 when the bowstring 16 is drawn. When the vertical arm 52 rotates, it frees the retainer loop 18 resulting in release of the bowstring 16. After completion of the fire signal (described above), the electronic driver 38 no longer powers the solenoid 40. Thus, the plunger 44 is released and returned to an upright position as the horizontal arm 48 returns to a rest position depicted in FIG. 4 by rotating in a clockwise direction about the pivot point 50 due to the tension in the spring 46.

Figure 6A:
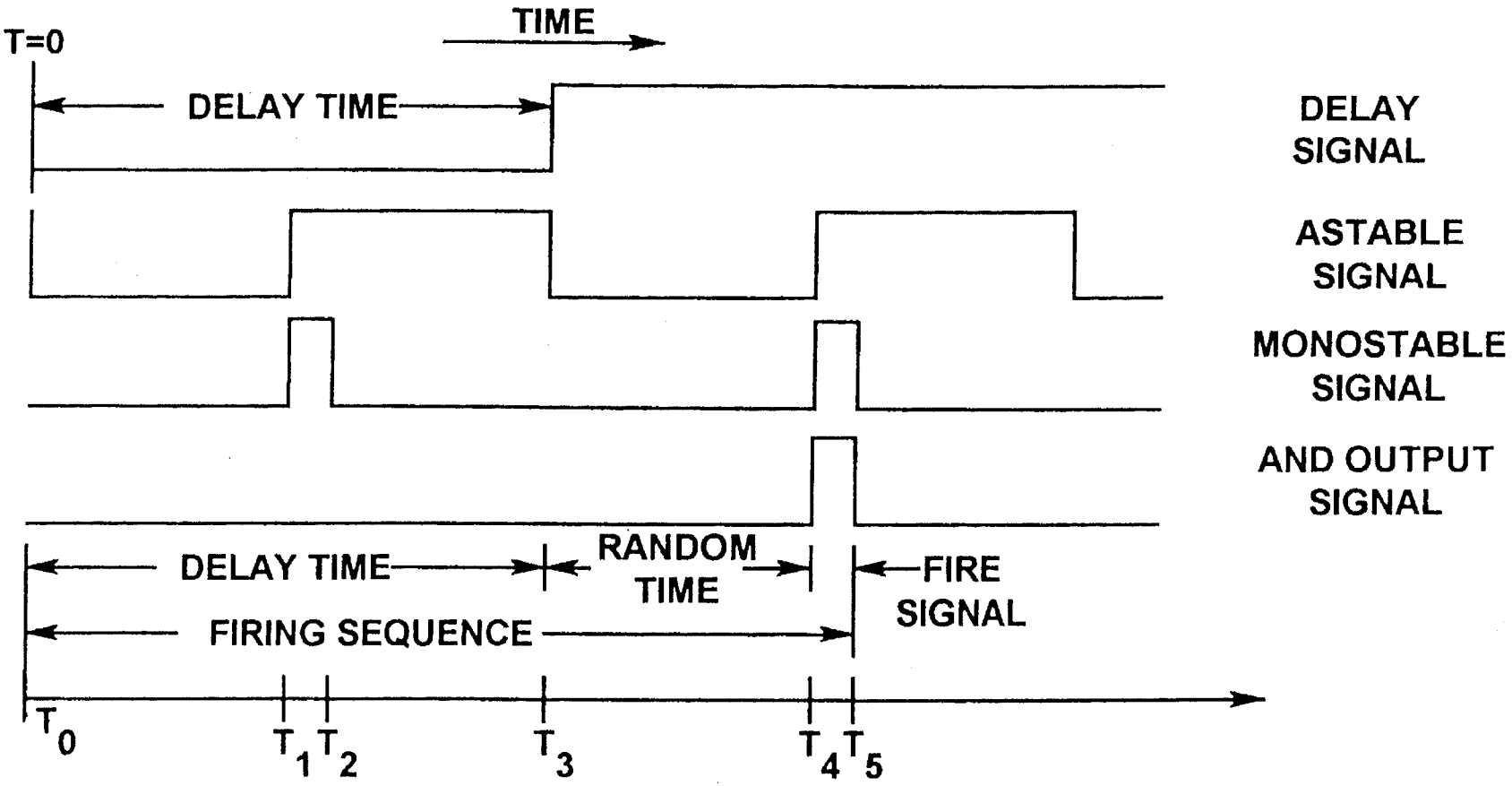
FIGS. 6A–6C show a timing diagram identifying the time relationship between the subcomponents of the timing device.
Figure 6B:
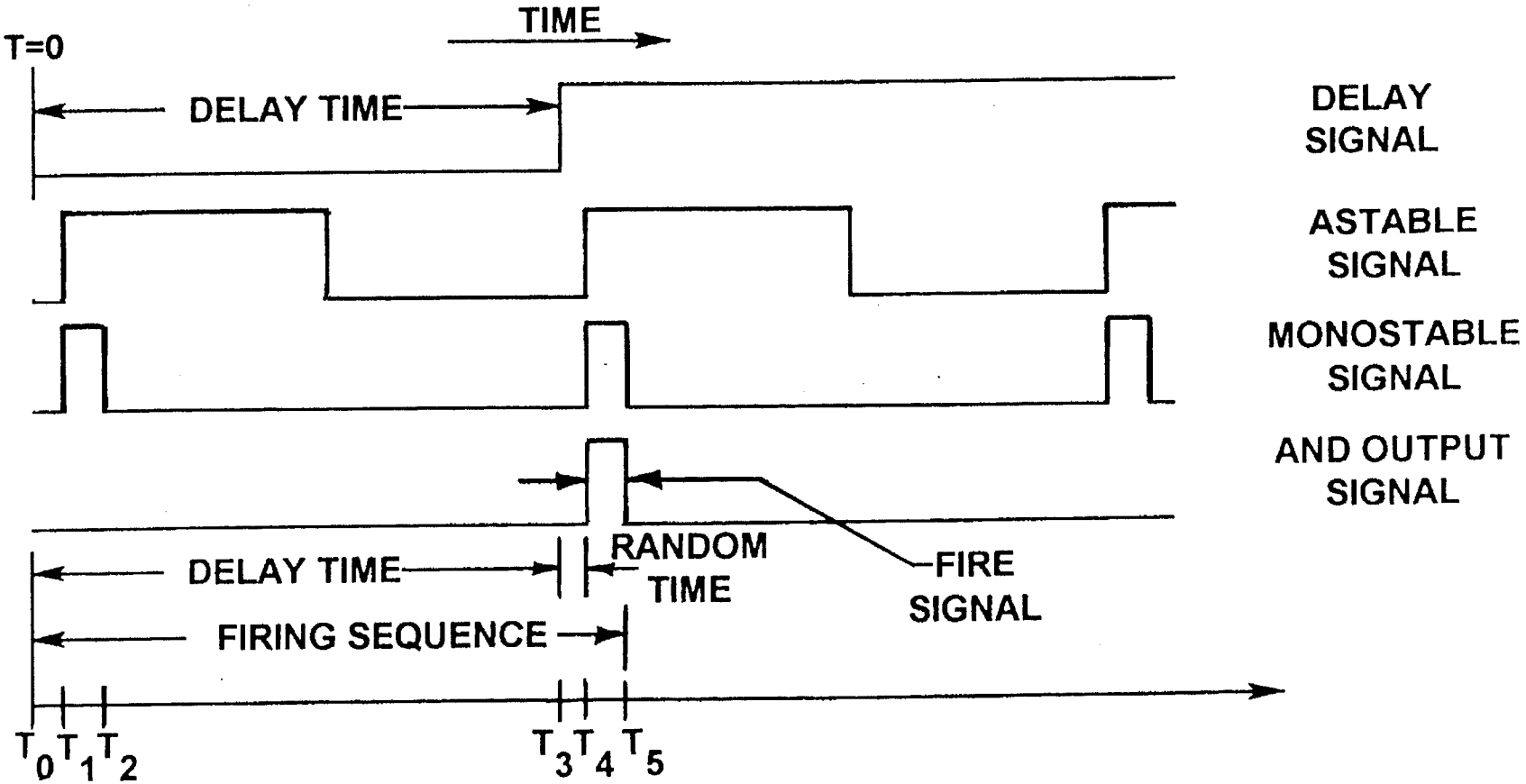
Figure 6C:
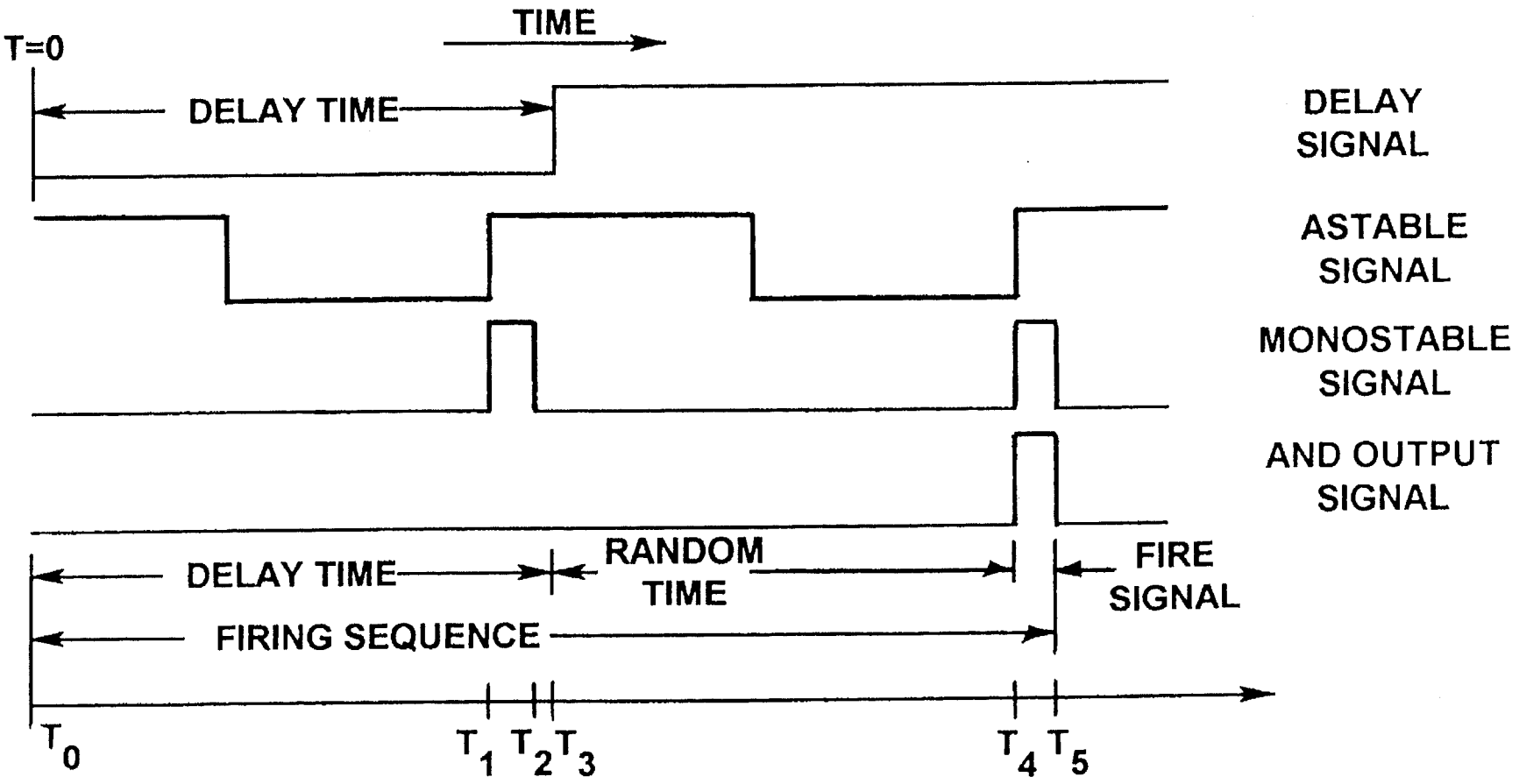

FIGS. 6A–6C are timing diagrams of the preferred embodiment identifying the time relationship between subcomponents of the timing device 24 (shown in FIG. 3). FIGS. 6A, 6B and 6C highlight the random nature of the invention by depicting the initiation of the firing sequence at different points in time in relation to the astable multivibrator 32 (shown in FIG. 3) period of oscillation. The random nature results in a firing signal being generated after any of a number of possible lengths of time.

Considering first FIG. 6A, time $T_0$ represents the arm signal transmitted upon actuation of the activation switch 20 and received by the constant time device 28 (shown in FIG. 3). The delay signal represents the output signal from the constant time device 28. The period $T_0$–$T_3$ represents the established delay time of the constant time device 28. After time $T_3$, the constant time device 28 transmits a continuous ready signal.

The astable signal square wave with period of oscillation from $T_1$–$T_4$ represents the output of the astable multivibrator 32 (shown in FIG. 3). The monostable signal of period of oscillation from $T_1$–$T_4$ represents the output of the monostable multivibrator 34 (shown in FIG. 3 ). The rising edge of the astable signal triggers the monostable signal to produce a brief (e.g. $T_1$–$T_2$ and $T_4$–$T_5$) square wave. The monostable signal functions as the ready signal for the random time device 30 (shown in FIG. 3). The ready signal of the random time device 30 is depicted over the periods $T_1$–$T_2$ and $T_4$–$T_5$. In contrast to the continuous ready state of the delay signal (beginning at $T_3$), the ready signal produced by the monostable signal only lasts for a short period of time (e.g. $T_1$–$T_2$ and $T_4$–$T_5$). The period of time between the expiration of the delay time and beginning of the fire signal is the random time from $T_3$–$T_4$.

The AND output signal represents the output of the AND gate 36 (shown in FIG. 3). The AND gate 36 creates the fire signal which is depicted over the period $T_4$–$T_5$. As a result of the rising edge of the fire signal at $T_4$, the release mechanism 26 (shown in FIG. 4) releases the bowstring 16 and fires the arrow 14 (shown in FIG. 1).

Basically, the firing sequence begins at $T_0$ with actuation of the activation switch 20 (shown in FIG. 1) transmitting the arm signal. The arm signal is received by the timing device 24 (shown in FIG. 3), more specifically the constant time device 28 (shown in FIG. 3 ), which initiates the delay time from $T_0$–$T_3$ as represented by the delay signal in a low state. After the delay time, the constant time device 28 continuously transmits the ready signal (at $T_3$) to the AND gate 36, represented by the delay signal going to a high state. In order for the AND gate 36 (shown in FIG. 3) to transmit the fire signal, the random time device 30 (shown in FIG. 3) must also be transmitting a ready signal, indicated in FIG. 6A by the monostable signal going to a high state as depicted from $T_1$–$T_2$ and $T_4$–$T_5$. The elapsed time from when the constant time device 28 transmits its ready signal at $T_3$ until the random time device 30 transmits its ready signal at $T_4$ is known as the random time. The random time varies in length depending upon when during the period of oscillation of the astable multivibrator 32 (shown in FIG. 3) the constant time device 28 transmits its ready signal. Recall the astable multivibrator 32 runs continuously and independently of the constant time device 28.

Completion of the random time at $T_4$ indicates the beginning of a new period of oscillation of the astable multivibrator 32 (shown in FIG. 3) depicted as the astable signal. The rising edge of the astable signal triggers the monostable multivibrator 34 (shown in FIG. 3), depicted as the monostable signal, thus beginning the ready signal of the random time device 30 (shown in FIG. 3). When receiving both ready signals, the AND gate 36 (shown in FIG. 3) transmits the fire signal depicted as the AND output signal from $T_4$–$T_5$. The rising edge of the fire signal at $T_4$ triggers the actual release of the bowstring 16 by the release mechanism 26 (shown in FIG. 4). Completion of the random time device 30 ready signal at $T_5$ marks the end of the firing sequence. As depicted, the entire random time delay comprises the delay time and random time taken together and occurring from $T_0$–$T_4$. Although the random time device 30 (shown in FIG. 3) creates a periodic ready signal, it becomes random due to its independent continuous operation and unknown initiation time of the firing sequence at time $T_0$ indicating depression of the activation switch 20 (shown in FIG. 1).

FIG. 6A depicts a medium length random time delay due to the delay time expiring after approximately half the period of oscillation of the astable signal. Thus the random time in FIG. 6A, from $T_3$–$T_4$, is approximately half a period of oscillation because the astable signal had to complete the current period of oscillation before triggering the monostable signal and sending another ready signal at $T_4$.

FIG. 6B contains the same reference time points but depicts a shorter random time delay than in FIG. 6A due to the delay time expiring late in the period of oscillation for the astable signal. Thus because the delay time expired at $T_3$ just prior to the astable signal beginning a new period of oscillation and triggering the monostable signal to send a ready signal at $T_4$, the total random time delay is shorter in relation to FIG. 6A.

Conversely, FIG. 6C also contains the same reference time points but depicts a longer random time delay. This is due to the delay time expiring early in the astable signals period of oscillation at time $T_3$. Thus the random time occurring until $T_4$ is increased in relation to FIG. 6A as more of the astable signal period of oscillation must expire prior to a new period beginning and triggering the ready signal at time $T_4$.

Figure 7:
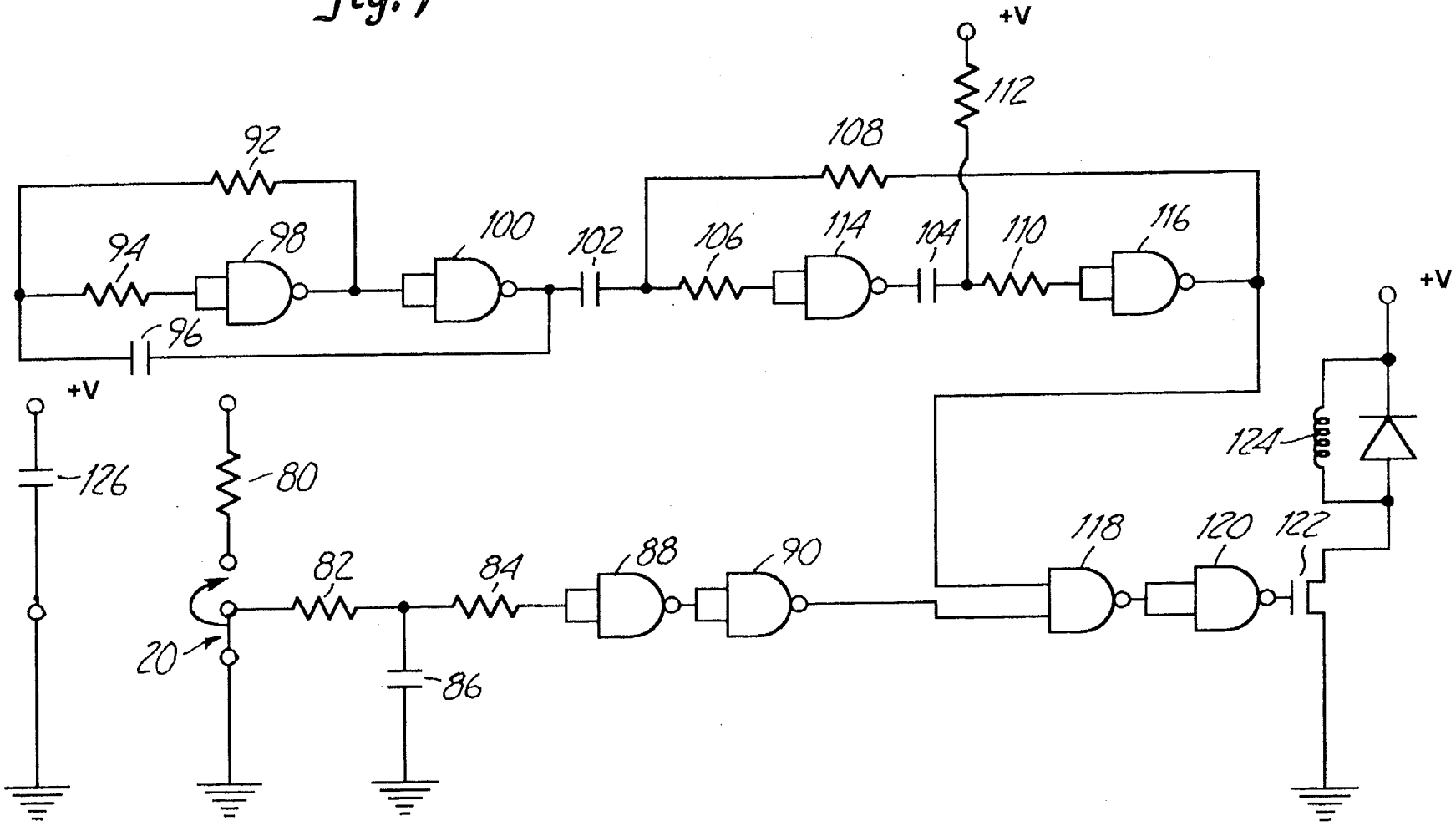
FIG. 7 is a circuit diagram of the bowstring release mechanism.

FIG. 7 depicts a circuit diagram of the preferred embodiment. The activation switch 20 is depicted in an open or inactivated position. The constant time device 28 (shown in FIG. 3) includes resistors 80, 82 and 84, a capacitor 86 and NAND gates 88 and 90. The delay time of the constant time device 28 is set by the resistor 80 and the capacitor 86. The resistor 82 is a discharge resistor and should be much less than the resistor 80 to allow the widest range of adjustment in the delay time of the constant time device 28. Furthermore, a low resistance value for the resistor 80 allows for a short reset time.

The astable multivibrator 32 (shown in FIG. 3) includes resistors 92 and 94, a capacitor 96, and NAND gates 98 and 100. The period of oscillation for the astable multivibrator is set by the capacitor 96 and the resistor 92. For proper current flow operation, the resistor 94 should be greater than the resistor 92.

The monostable multivibrator 34 (shown in FIG. 3) includes capacitors 102 and 104, resistors 106, 108, 110 and 112, and NAND gates 114 and 116. The duration of the random time device 30 (shown in FIG. 3) ready signal, and therefore the AND gate 36 (shown in FIG. 3) fire signal, is set by the resistors 108 and 112, and the capacitors 102 and 104. The resistors 106 and 110 function as current limiting resistors.

The AND gate 36 (shown in FIG. 3) is formed by NAND gate 118 and NAND gate 120 (which acts as an inverter). The electronic driver 38 of the release mechanism 26 (shown in FIG. 3) is depicted as a field effect transistor (FET) 122. The solenoid 40 (shown in FIG. 3) is depicted as a coil 124. A voltage source for the circuit is indicated by +V and a capacitor 126 acts as a decoupling capacitor to the voltage source.

A preferred embodiment of the present invention allows for the ability to program the delay time and random time created from the constant time device 28 and random time device 30 (shown in FIG. 3). Adjusting the resistor 80 will alter the delay time associated with the constant time device 28 while adjusting the resistor 92 will alter the random time associated with the random time device 30. The ability to adjust these resistor values can be accomplished by use of a potentiometer, a set of dip switches or other similar means. Thus, the archer 12 (shown in FIG. 1) is able to program or set a plurality of lengths of time representing the random time delay.

As described, the bowstring release mechanism 10 improves an archer 12 shot by assisting in overcoming archer flinching or movement at the critical time of releasing the bowstring 16 (shown in FIG. 1). Insertion of a random time delay between actuation of the activation switch 20 and release of the bowstring 16 prevents archer anticipation of the shot. Also, the random time delay allows the archer to focus exclusively on aiming after actuating the activation switch and beginning the firing sequence thus preventing mental deterioration. Finally, by establishing a range of potential random time delays and simplifying the required actions by the archer 12 during the firing sequence, the potential for physical breakdown is dramatically decreased. Thus the bowstring release mechanism 10 not only assists the archer 12 in improving shot accuracy but also provides an opportunity to experience a perfectly released shot.

Although the present invention has been described with reference to preferred embodiments, workers skilled in the art will recognize that changes may be made in form and detail without departing from the spirit and scope of the invention. For example different circuit techniques or components could be substituted for circuitry used in the preferred embodiment as well as various mechanical means to releasably secure the bowstring 16. A few of the different circuit techniques or components could be the use of a potentiometer, dip switches or similar resistor variance techniques for resistors 80 and 92 (shown in FIG. 7) to allow for their variance and therefore the variance of the random time delay as composed of the delay time and the random time (shown in FIG. 6).

Counters or other logic gate designs could be substituted for the design disclosed in the preferred embodiment while achieving the same functionality of creating an unknown time delay between the beginning of a firing sequence and the release of the bowstring 16 (shown in FIG. 1). The location and number of activation switches 20 provided to the archer 12 for activation could be varied to account for individual preferences (shown in FIG. 1). Various mechanical means used to releasably secure the bowstring other than the preferred embodiment have been disclosed in U.S. Pat. Nos. 5,243,957; 5,027,786; and 5,025,772. Finally, while the electronic release mechanism has been preferably applied to a bowstring, other shooting devices requiring random delay between actuation of a firing switch and actual firing are equally applicable. For example, the present invention could easily be modified to fit within a gun, such that after actuating the trigger, a random delay period takes place prior to actual propulsion of the projectile. With this device, a target shooter will overcome the problems associated with shoot anticipation, physical breakdown and mental deterioration.

What is claimed is:

1. A release apparatus for use with a projectile firing device, the release apparatus comprising:

an activation switch for initiating a time period;

an electrical timing device connected to the activation switch for establishing a length of the time period; and a release mechanism connected to the timing device for propelling the projectile upon expiration of the time period.

2. The release apparatus of claim 1 wherein the time period established by the electrical timing device is random.

3. The release apparatus of claim 1 wherein the electrical timing device comprises a constant time device and a random time device which together establish the length of time representing the time period.

4. The release apparatus of claim 1 wherein the electrical timing device includes a plurality of programmable lengths of time representing the time period.

5. The release apparatus of claim 1 wherein the projectile is an arrow and wherein the release mechanism is connected to the electrical timing device for securing a bowstring of a bow until expiration of the time period.

6. A bowstring release apparatus for use with a bowstring affixed to a bow, the bowstring release apparatus comprising:

a release mechanism for securing the bowstring until expiration of a time period;

an activation switch for initiating the time period; and an electrical timing device for establishing a length of the time period.

7. The bowstring release apparatus of claim 6 wherein the time period established by the electrical timing device is random.

8. The bowstring release apparatus of claim 6 wherein the electrical timing device comprises a constant time device and a random time device which together establish the length of time representing the time period.

9. The bowstring release apparatus of claim 6 wherein the electrical timing device includes a plurality of programmable lengths of time representing the time periods.

10. A method for improving shooting accuracy of an archer using a bow, a bowstring affixed to the bow, an arrow and a bowstring release apparatus, the method including:

drawing a bowstring;

activating an activation switch; and releasing the bowstring after completion of a time period, wherein duration of the time period is determined by an electrical timing device which is responsive to the activating of the activation switch.

11. The method of claim 10 wherein the duration of the time period is programmable by the archer.

12. A method for improving shooting accuracy of an archer by providing a bow, a bowstring affixed to the bow, an arrow and a bowstring release apparatus, the method including:

securing the bowstring into the bowstring release apparatus;

drawing the bowstring via the bowstring release apparatus;

activating an activation switch connected to the bowstring release apparatus; and releasing the bowstring from the bowstring release apparatus after completion of a time period following the activating of the activation switch, wherein duration of the time period is determined by an electrical timing device to prevent archer anticipation.

13. The method of claim 12 wherein the duration of the time period is programmable by the archer.

14. A bowstring release apparatus for use with a bowstring affixed to a bow, the bowstring release apparatus comprising:

an activation switch for initialing an arm signal;

an electrical timing device connected to the activation switch for receiving the arm signal and for generating a fire signal following a time delay after receiving the arm signal; and a release mechanism connected to the timing device for securing the bowstring until receipt of the fire signal.

* * * * *